US009501984B2

(12) United States Patent
Chang et al.

(10) Patent No.: US 9,501,984 B2
(45) Date of Patent: Nov. 22, 2016

(54) DRIVING DEVICE AND DRIVING DEVICE CONTROL METHOD THEREOF

(71) Applicant: NOVATEK Microelectronics Corp., Hsin-Chu (TW)

(72) Inventors: Han-Ying Chang, Hsinchu (TW); Chu-Ya Hsiao, Hsinchu (TW); Wen-Yuan Tsao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 14/641,425

(22) Filed: Mar. 8, 2015

(65) Prior Publication Data

US 2016/0171942 A1 Jun. 16, 2016

(30) Foreign Application Priority Data

Dec. 16, 2014 (TW) ..... 103143924 A

(51) Int. Cl.
*G09G 3/36* (2006.01)

(52) U.S. Cl.
CPC ..... *G09G 3/3611* (2013.01); *G09G 2330/021* (2013.01)

(58) Field of Classification Search
CPC ..... G09G 3/3648; G09G 3/3614; G09G 2330/021
See application file for complete search history.

(56) References Cited

U.S. PATENT DOCUMENTS

| | | | | |
|---|---|---|---|---|
| 6,885,568 | B2 * | 4/2005 | Kernahan | H02M 3/157 363/132 |
| 2009/0002291 | A1 | 1/2009 | Koo | |
| 2009/0303166 | A1 * | 12/2009 | Tsubata | G09G 3/342 345/87 |
| 2010/0162037 | A1 * | 6/2010 | Maule | G06F 11/106 714/5.11 |
| 2011/0299317 | A1 * | 12/2011 | Shaeffer | G11C 13/0002 365/106 |
| 2014/0111494 | A1 * | 4/2014 | Su | G09G 3/3614 345/209 |
| 2014/0210804 | A1 | 7/2014 | Liao | |
| 2014/0320464 | A1 | 10/2014 | Ryu | |
| 2014/0368415 | A1 | 12/2014 | Kim | |

* cited by examiner

*Primary Examiner* — Ricardo L Osorio
(74) *Attorney, Agent, or Firm* — Winston Hsu; Scott Margo

(57) ABSTRACT

A driving device includes a driving module, for generating a plurality of driving signals according to a plurality of next channel data and adjusting coupling relationships of the plurality of driving signals according to a charge sharing control signal; and a timing control module, for generating the plurality of next channel data and selecting one of a plurality of charge sharing control commands as the charge sharing control signal.

13 Claims, 9 Drawing Sheets

DRIVING DEVICE AND DRIVING DEVICE CONTROL METHOD THEREOF

BACKGROUND OF THE INVENTION

1. Field of the Invention

The present invention relates to a driving device used for driving a display panel and driving device control method thereof, and more particularly, to a driving device capable of optimizing the power consumption according to the variations of channel data over time and driving device control method thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

As technology advances, the resolutions and the refreshing speed of the LCD are significantly improved, resulting that the power consumption of the driving system in the LCD is dramatically increased. In such a condition, the interior temperature of the driving system in the LCD is also violently increased, such that the reliability of the driving system is reduced. Thus, how to decrease the power consumption of the driving system in the LCD becomes a topic to be discussed.

SUMMARY OF THE INVENTION

In order to solve the above problem, the present invention provides a driving device capable of optimizing the power consumption according to the variations of channel data over time and driving device control method thereof.

In an aspect, the present invention discloses a driving device. The driving device comprises a driving module, for generating a plurality of driving signals according to a plurality of next channel data and adjusting coupling relationships of the plurality of driving signals according to a charge sharing control signal; and a timing control module, for generating the plurality of next channel data and selecting one of a plurality of charge sharing control commands as the charge sharing control signal.

In another aspect, the present invention discloses a driving device control method. The driving device control method comprises generating a plurality of driving signals according to a plurality of next channel data; selecting one of a plurality of charge sharing control commands as a charge sharing control signal; and adjusting coupling relationships of the plurality of driving signals according to the charge sharing control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
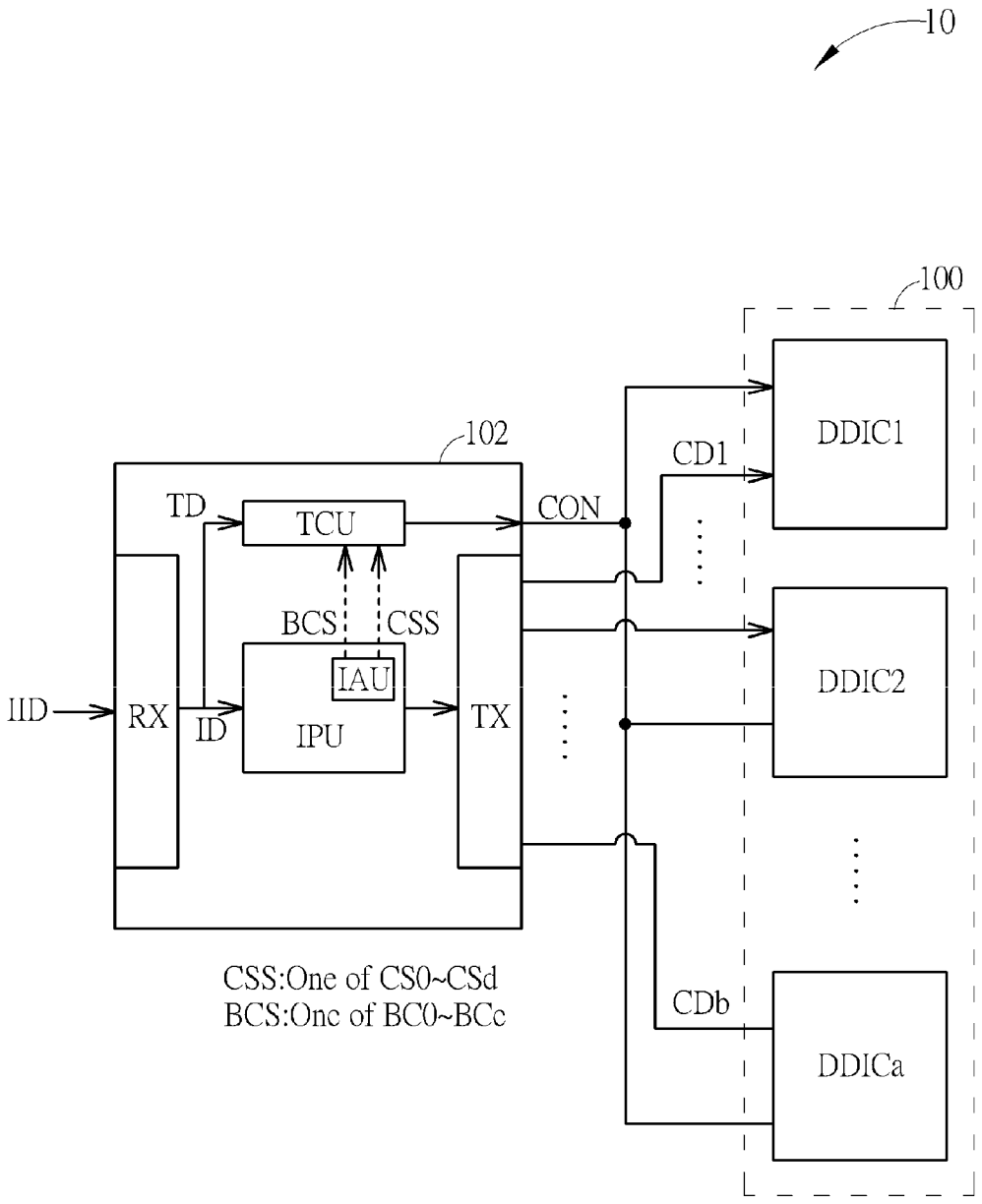
FIG. 1 is a schematic diagram of a driving device according to an embodiment of the present invention.

Please refer to FIG. 1, which is a schematic diagram of a driving device 10 according to an embodiment of the present invention. The driving device 10 may be utilized in an electronic product with a display panel, such as a smart phone, a laptop, or a liquid crystal display (LCD). As shown in FIG. 1, the driving device 10 comprises a driving module 100 and a timing control module 102. The driving module 100 comprises a plurality of driving units DDIC1-DDICa used for generating driving signals Y1-Yc (not shown in FIG. 1) on display components (e.g. data lines) of a display panel according to the channel data CD1-CDb and the control signal CON. According to different applications and modifications, the number of driving signals generated by each of the driving units DDIC1-DDICa may be appropriately changed. The timing control module 102 comprises a receiving unit RX, an image processing unit IPU, a timing control unit TCU and a transmitting unit TX. The timing control module 102 is not only utilized for generating the channel data CD1-CDb to the driving units DDIC1-DDICa but also utilized for selecting and transmitting different commands to the driving units DDIC1-DDICa according to the signals used for generating the driving signals Y1-Yc (e.g. the channel data CD1-CDb and the control signal CON), so as to optimize the power consumptions of the driving units DDIC1-DDICa.

In details, the receiving unit RX transmits timing data TD and image data ID to the timing control unit TCU and the image processing unit IPU, respectively, after receiving an input image data IID. According to the timing data RD, the timing control unit TCU changes the timing sequences of the driving units DDIC1-DDICa adjusting the driving signals Y1-Yc. In addition, the image processing unit IPU generates the channel data CD1-CDb according to the image data ID and respectively transmits the channel data CD1-CDb to the driving units DDIC1-DDICa via the transmitting unit TX. According to different applications and design concepts, the transmission interface between the driving module 100 and the timing control module 102 may be appropriately altered. For example, the transmission interface between the driving module 100 and the timing control module 102 may be a point to point interface (PHI), and is not limited herein. The operation principles of the timing control module 102 generating channel data CD1-CDb and the control signals CON according to the input image data IID should be well-known to those with ordinary skill in the art, and are not narrated herein for brevity.

Further, the image processing unit IPU comprises an image algorithm unit IAU which is utilized for selecting and transmitting a charge sharing control signal CSS and a bias control signal BCS to the driving unit DDIC1-DDICa according to the signals used for generating the driving signal Y1-Yc (e.g. the channel data CD1-CDb and the control signal CON). For example, the image algorithm unit IAU may determine whether the signals used for generating the driving signals Y1-Yc are satisfied one of a plurality of charge sharing conditions CSC0-CSCd, to select one of a plurality of charge sharing control command CS0-CSd as the charge sharing control signal CSS, so as to optimize the power consumptions of the driving units DDIC1-DDICa.

In an embodiment, the control signal CON comprises a polarity signal POL used for indicating polarities of the driving signals Y1-Yc. When the polarity signal POL is switched in a line period LPi, the polarities of the driving signals Y1-Yc are switched in a line period LPi+1 subsequent to the line period LPi. In such a condition, the image algorithm unit IAU determines the charge sharing condition CSC0 is satisfied and selects the charge sharing control command CS0 as the charge sharing control signal CSS. Via embedding the charge sharing control signal CSS in the control signal CON, the driving units DDIC1-DDICa receive the charge sharing control signal CSS and couple each of the driving signals Y1-Yc to each other before the line period LPi ends, to perform the charge sharing on the driving signals Y1-Yc. The power consumptions of the driving units DDIC1-DDICa are decreased, therefore.

In another embodiment, when the difference between channel data CDx of the channel data CD1-CDb within the line period LPi and the channel data CDx within the line period LPi+1 subsequent to the line period LPi is significant, driving signals Yj, Yj+1 corresponding to the channel data CDx would dramatically varies from the line periods LPi+1 to LPi+2. In such a condition, the image algorithm unit IAU determines the charge sharing condition CSC1 is satisfied and selects the charge sharing control command CS1 as the charge sharing control signal CSS. Via embedding the charge sharing control signal CSS in the control signal CON, the driving units DDIC1-DDICa receive the charge sharing control signal CSS and couple the driving signals Yj and Yj+1 before the line period LPi+1 ends, to perform the charge sharing. The power consumptions of generating the driving signals Yj and Yj+1 is reduced, therefore.

As to the process of the image algorithm unit IAU selecting the charge sharing control command CS1 in the line periods LPi and LPi+1 according to the channel data CDx please refer to the followings. The following example assumes the channel data CDx is a digital value DC1 in the line period LPi and is a digital value DC2 in the line period LPi+1 subsequent to the line period LPi. When the digital value DC1 is greater than a threshold TH1 and the digital value DC2 is smaller than a threshold TH2, the image algorithm unit IAU determines the charge sharing condition CSC1 is satisfied. The image algorithm unit IAU selects and transmits the charge sharing control command CS1 to the driving unit utilized for generating the driving signals Yj, Yj+1 in the driving units DDIC1-DDICa, to make the driving signals Yj, Yj+1 to perform the charge sharing before the line period LPi+1 ends. The power consumption of the driving module 100 is reduced, therefore. In an example, when the format of the channel data CDx is Hexadecimal and the number of bits of the channel data CDx is 2, the threshold TH1 may be BF and the threshold TH2 may be 40. That is, the image algorithm unit IAU selects and transmits the charge sharing control command CS1 as the charge sharing control signal CSS when the digital value DC1 is within C0-FF and the digital value DC2 is within 00-3F, to optimize the power consumptions of the driving units DDIC1-DDICa.

Figure 2:
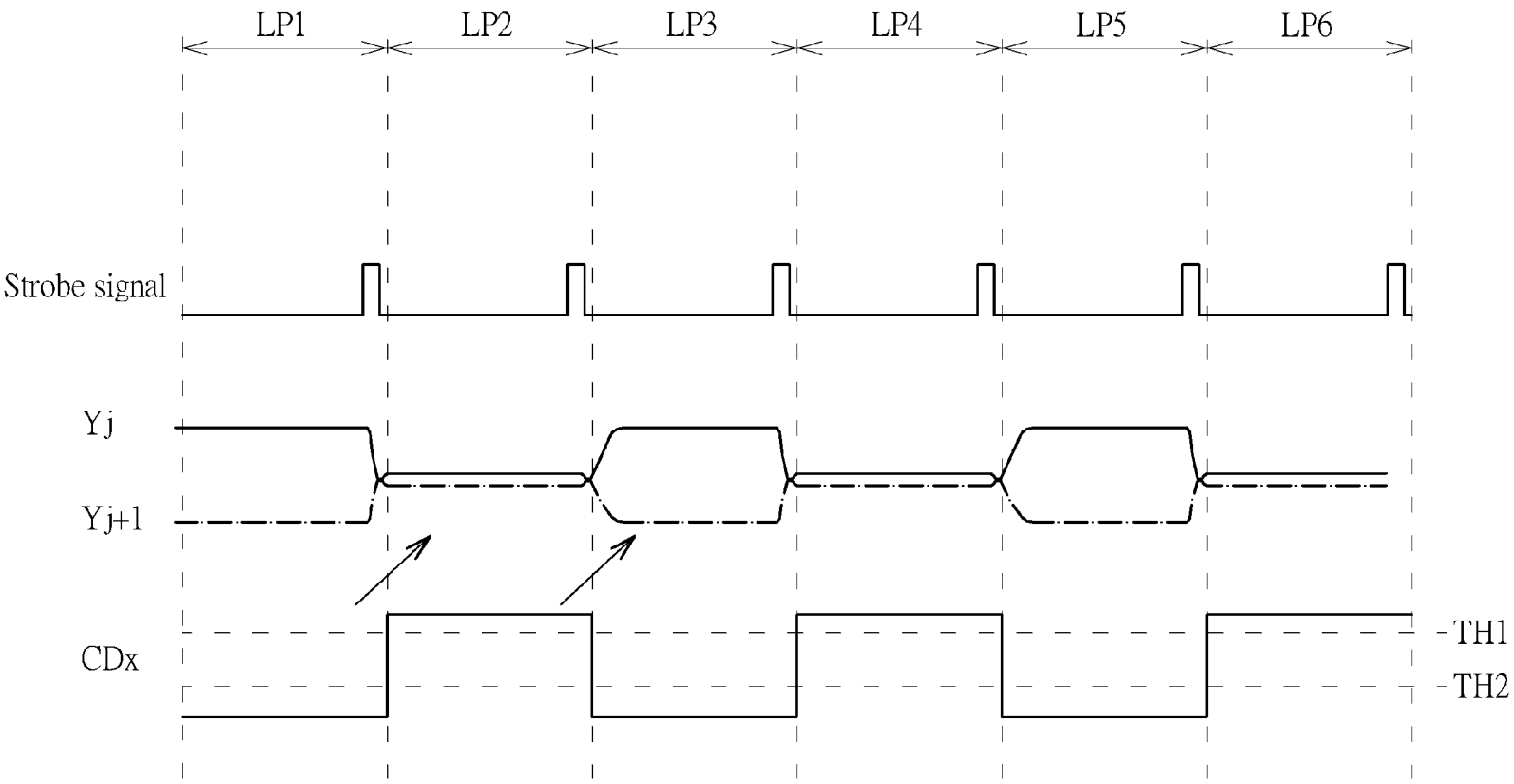
FIG. 2 is a schematic of related signals when the driving device shown in FIG. 1 operates.

Please refer to FIG. 2, which is a schematic diagram of related signals when the driving device 10 shown in FIG. 1 operates, wherein the driving signals Yj and Yj+1 equip with different polarities and are corresponding to the channel data CDx. In FIG. 2, the channel data CDx in the line period LP1 is corresponding to the driving signals Yj and Yj+1 in the line period LP2, the channel data CDx in the line period LP2 is corresponding to the driving signals Yj and Yj+1 in the line period LP3, and so on. Since the channel data CDx is smaller than the threshold TH2 in the line period LP1 and is greater than the threshold TH1 in the line period LP2, the image algorithm unit IAU selects the charge sharing control command CS1 as the charge sharing control signal CSS. After receiving the charge sharing control command CS1, the driving units used for generating the driving signals Yj and Yj+1 couples the driving signals Yj and Yj+1 for performing the charge sharing before the line period LP2 ends according to a strobe signal. Similarly, since the channel data CDx is greater than the threshold TH1 in the line period LP2 and is smaller than the threshold TH2 in the line period LP2, the image algorithm unit IAU selects the charge sharing control command CS1 as the charge sharing control signal CSS, to make the driving signals Yj and Yj+1 to perform the charge sharing before the line period LP3 ends. The power consumption is accordingly optimized.

In order to reduce the hardware cost of realizing the driving device 10, the image algorithm unit IAU may select the charge sharing control command CS1 according to statistics of the channel data CD1-CDb. For example, the image algorithm unit IAU may select the charge sharing control command CS1 as the charge sharing control signal CSS when a difference between an average of the channel data CD1-CDb in the line period LPi and that of the channel data CD1-CDb in the line period LPi+1 is significant. Via embedding the charge sharing control signal CSS in the control signal CON, the driving units DDIC1-DDICa acquires the charge sharing control command CS1 and couples the driving signals Y1-Yc before the line period LPi+1 ends. The power consumption of the driving units DDIC1-DDICa is reduced via the charge sharing.

In another embodiment, the image algorithm unit IAU divides the channel data CD1-CDb into channel data groups CDG1-CDGd according to the channel sequence corresponding to the channel data CD1-CDb (e.g. the sequence of the driving signals Y1-Yc), wherein each of the channel data group CDG1-CDGd comprises at least two channel data corresponding to adjacent channels and is not limited herein. In order to simplify illustrations, the followings utilize a channel data group CDGy as an example. The channel data group CDGy comprises channel data CDz, CDz+1 and CDz+2 and the channel data CDz, CDz+1 and CDz+2 are respectively corresponding to the driving signals Yj, Yj+1, Yj+2, Yj+3 and Yj+4, Yj+5. According to the channel data CDz, CDz+1 and CDz+2 in the line periods LPi and LPi+1, the image algorithm unit IAU calculates the power consumption of the driving units DDIC1-DDICa generating the driving signals Yj-Yj+5 in the line periods LPi+1 and LPi+2. Next, the image algorithm unit IAU calculates the power consumption of the driving units DDIC1-DDICa generating the driving signals Yj-Yj+5 in the line periods LPi+1 and LPi+2 under the condition of performing the charge sharing on the driving signals Yj, Yj+2 and Yj+4 and the driving signals Yj+1, Yj+3 and Yj+5 (i.e. the driving signals with the same polarity) before the line period LPi+1 ends. If the power consumption of generating the driving signals Yj-Yj+5 is decreased when the charge sharing is performed, the image algorithm unit IAU determines the charge sharing condition CSC2 is satisfied and selects the charge sharing control command CS2 as the charge sharing control signal CSS. In an example, the image algorithm unit IAU acquires the power consumption of the driving units DDIC1-DDICa generating the driving signals Yj-Yj+5 via calculating a sum SUM1 of the differences between each of the channel data CDz, CDz+1, CDz+2 in the line periods LPi and LPi+1. In addition, the image algorithm unit IAU acquires the power consumption of the driving units DDIC1-DDICa generating the driving signals Yj-Yj+5 when performing the charge sharing via calculating a sum SUM2 of the differences between the averages of the channel data CDz, CDz+1, CDz+2 in the line periods LPi and LPi+1. When the sum SUM2 is smaller than the sum SUM1, the image algorithm unit IAU determines the charge sharing condition CSC2 is satisfied and selects the charge sharing control command CS2 as the charge sharing control signal CSS.

Via embedding the charge sharing control signal CSS in the control signal CON, the driving unit used for generating the driving signals Yj-Yj+5 in the driving units DDIC1-DDICa acquires the charge sharing control command CS2, and then couples the driving signals Yj, Yj+2, Yj+4 and Yj+1, Yj+3, Yj+5 before the line period LPi+1 ends, to perform the charge sharing. The power consumption is decreased, therefore.

Figure 3:
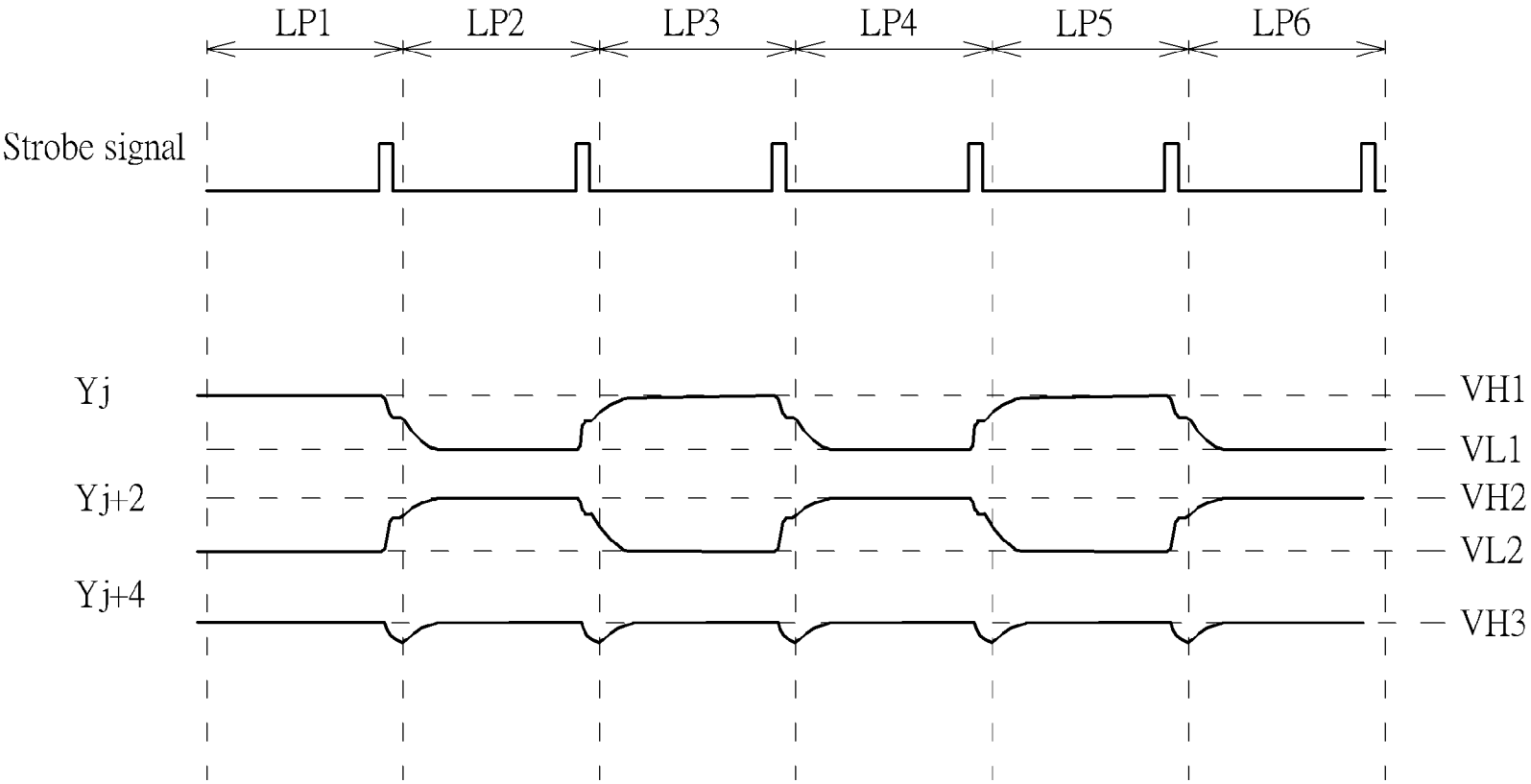
FIG. 3 is a schematic of related signals when the driving device shown in FIG. 1 operates.
Figure 4:
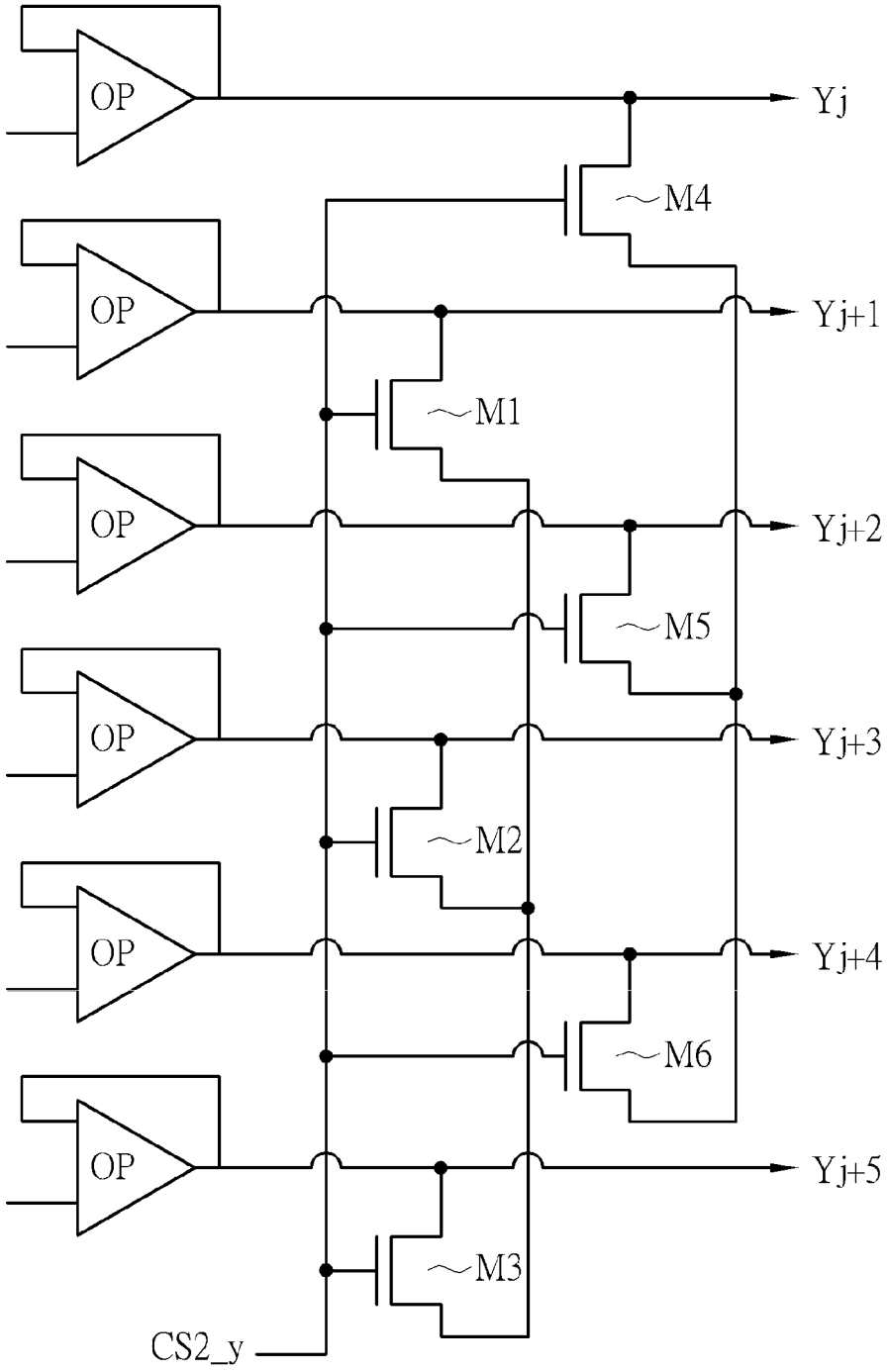
FIG. 4 is a schematic diagram of parts of components of the driving unit shown in FIG. 1.

Please refer to FIGS. 3 and 4, wherein FIG. 3 is a schematic diagram of related signals when the driving device 10 shown in FIG. 1 operates and FIG. 4 is a schematic diagram of parts of components in the driving units DDIC1-DDICa shown in FIG. 1. The driving signals Yj, Yj+2 and Yj+4 corresponding to the same channel data group CDGy are shown in FIG. 3 for illustrations and the driving signals Yj+1, Yj+3 and Yj+5, which are corresponding to the channel data group CDGy and have the polarity different from that of the driving signals Yj, Yj+2 and Yj+4, are not shown in FIG. 3 for brevity. In addition, FIG. 4 shows a plurality of output stages OP, the driving signals Yj-Yj+5 and transistors M1-M6. As shown in FIG. 3, target voltages of the driving signal Yj in the line periods LP1 and LP2 are voltages VH1 and VL1, respectively, target voltages of the driving signal Yj+2 in the line periods LP1 and LP2 are voltages VH2 and VL2, respectively, and target voltages of the driving signal Yj+4 in the line periods LP1 and LP2 are a voltage VH3. According to the channel data CDz, CDz+1 and CDz+2 of the channel data group CDGy, the image algorithm unit IAU acknowledges that the power consumption of generating the driving signals Yj-Yj+5 is reduced when performing the charge sharing before the line period LP1 ends, and selects the charge sharing control command CS2 as the charge sharing control signal CSS. Please jointly refer to FIG. 4. According to the charge sharing control command CS2 and the strobe signal, the driving unit used for generating the driving signals Yj-Yj+5 conducts the transistors M1-M6 via a control signal CS2_y before the line period LP1 ends. The driving signals Yj, Yj+2, Yj+4 and the driving signals Yj+1, Yj+3, Yj+5 perform the charge sharing, respectively, and the power consumption of generating the driving signals Yj-Yj+5 is therefore reduced.

In order to decrease the hardware cost of the driving device 10, the image algorithm unit IAU may determine whether the power consumption is reduced when the driving signals corresponding to each of the channel data groups CDG1-CDGd perform the charge sharing via calculating the sum of differences between each of the channel data CD1-CDb in the line periods LPi and LPi+1 (e.g. the sum of the differences of the channel data corresponding to adjacent scan lines in the channel data CD1-CDb). When the power consumption can be reduced, the image algorithm unit IAU selects and transmits the charge sharing control command CS2 to the driving units DDIC1-DDICa and the driving units DDIC1-DDICa couples the driving signals with the same polarity in each of channel data groups CDG1-CDGb for performing the charge sharing.

According to different applications and design concepts, the charge sharing conditions CSC0-CSCd can be appropriately modified and extended, and are not limited to the abovementioned charge sharing conditions CSC0-CSC2.

In addition, the image algorithm unit IAU selects one of biasing current command BC0-BCe as the biasing current signal BCS according to the variations of the channel data CD1-CDb over time, to adjust the static currents of the driving units DDIC1-DDICa generating the driving signals Y1-Yc (e.g. the static currents of the output stages OP shown in FIG. 4). For example, the image algorithm unit IAU may select one of the biasing current command BC0-BCe as the biasing current signal BCS according to the difference between the channel data CDx of the channel data CD1-CDb in the line period LPi and the channel data CDx in the line period LPi+1 subsequent to the line period LPi+1. The static currents of generating the driving signals Yj and Yj+1 corresponding to the channel data CDx are appropriately adjusted to be proportional to the differences between the channel data CDx in the line periods LPi and LPi+1 (i.e. the difference between the channel data CDx corresponding to adjacent scan lines).

Figure 5:
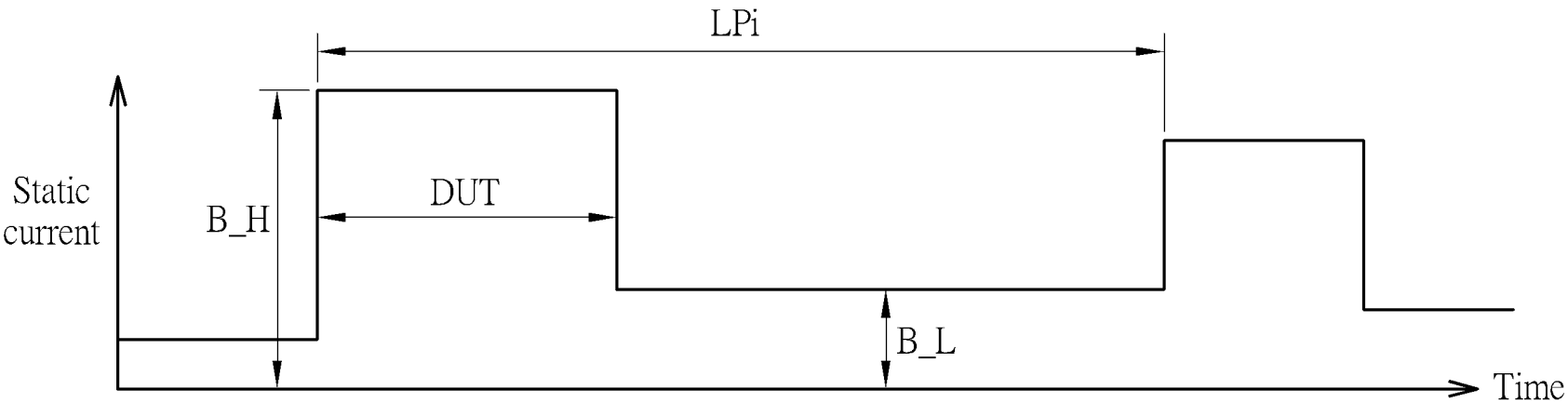
FIG. 5 is a schematic diagram of static current of one of the driving signals generated by the driving device shown in FIG. 1.

Please refer to FIG. 5, which is a schematic diagram of a static current of the driving units DDIC1-DDICa generating one of the driving signals Y1-Yc. As shown in FIG. 5, the image algorithm unit IAU adjusts the maximum B_H of the static current, the minimum B_L of the static current and a duty cycle DUT of the static current maintaining at the maximum B_H in the line period LPi according to the variations of the channel data CD1-CDb over time. The maximum B_H, the minimum B_L and the duty cycle DUT are proportional to the differences between each the channel data CD1-CDb corresponding adjacent scan lines in this example.

In order to decease the hardware cost, the image algorithm unit IAU may select one of the biasing current commands BC0-BCe to adjust the static currents of generating the driving signals Y1-Yc (e.g. the static current of the output stages OP in the driving units DDIC1-DDICa) according to the maximum difference among the differences between each of the channel data CD1-CDb in the line periods LPi and LPi+1 (i.e. the maximum difference between the channel data corresponding to adjacent scan lines). In addition, the image algorithm unit IAU may adjust the static currents of the driving units DDIC1-DDICa via the method of dividing the channel data CD1-CDb into the channel data groups CDG1-CDGd.

Figure 6:
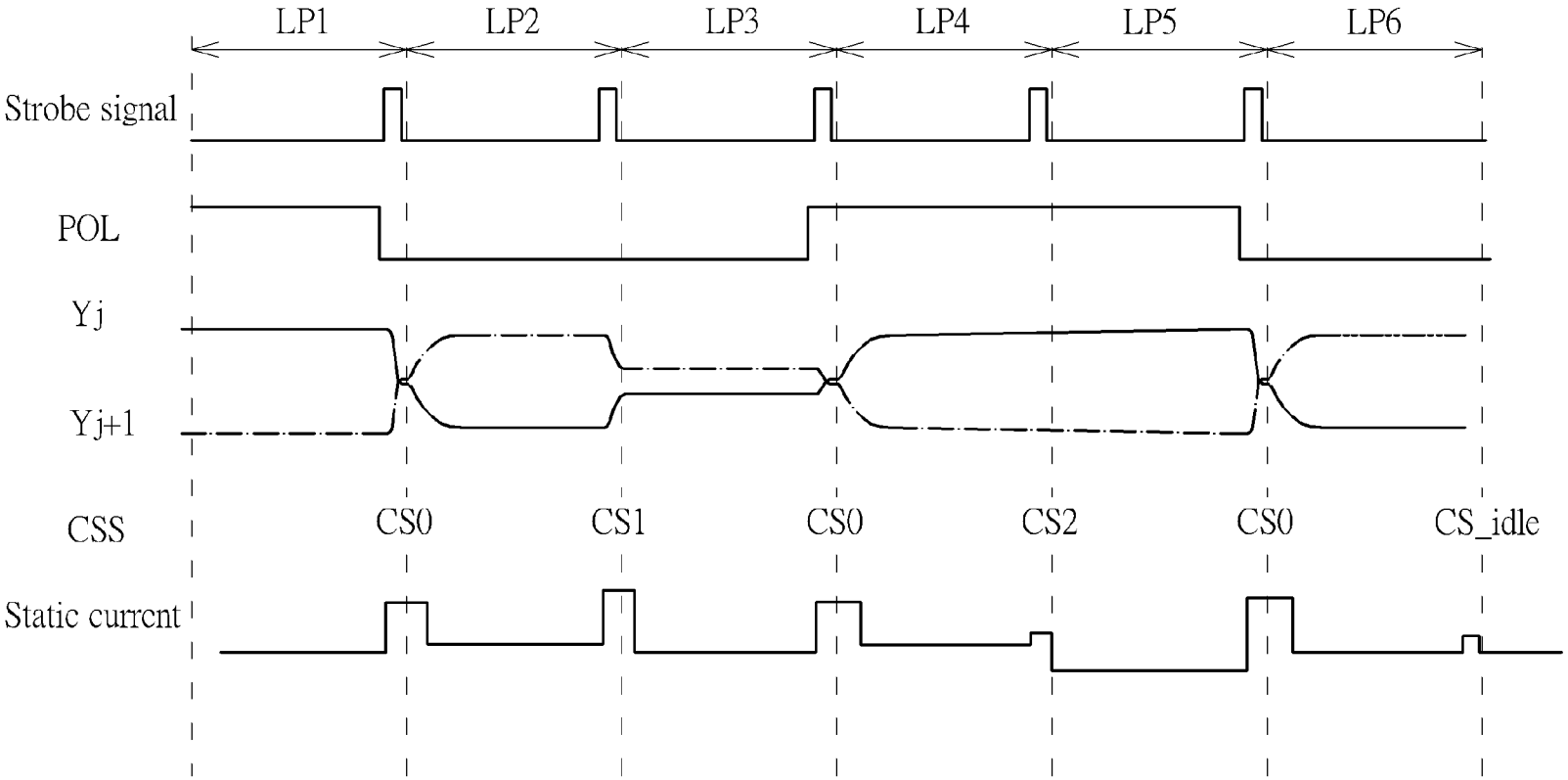
FIG. 6 is a schematic of related signals when the driving device shown in FIG. 1 operates.

Please refer to FIG. 6, which is a schematic diagram of related signals when the driving device 10 shown in FIG. 1 operates. FIG. 6 only shows the driving signals Yj and Yj+1, which have different polarities and are corresponding to the channel data CDx, for illustrations and rest driving signals in the driving signals Y1-Yc are omitted for brevity. As shown in FIG. 6, since the polarity signal POL is switched before the line period LP1, the image algorithm unit IAU determines the charge sharing condition CSC0 is satisfied and selects the charge sharing control command CS0 as the charge sharing control signal CSS. In such a condition, the driving signals Y1-Yc perform the charge sharing before the line period LP1 ends.

Next, the polarity signal POL is not switched before the line period LP2 ends. The image algorithm unit IAU determines the charge sharing condition CSC0 is not satisfied and further determines whether the charge sharing condition CSC1 is satisfied. As can be seen from the voltage of the driving signals Yj and Yj+1 in the line periods LP2 and LP3, the channel data CDx is greater than the threshold TH1 in the line period LP1 and is smaller than the threshold TH2 in the line period LP2. The image algorithm unit IAU determines the charge sharing condition CSC1 is satisfied and selects the charge sharing control command CS1 as the charge sharing control signal CSS, to make the driving signals Yj and Yj+1 to perform the charge sharing before the line period LP2 ends.

Similar to the line period LP1, the polarity signal POL is switched before the line period LP3 ends. The image algorithm unit IAU determines the charge sharing condition CSC0 is satisfied and selects the charge sharing control command CS0 as the charge sharing control signal CSS, for making the driving signals Y1-Yc to perform the charge sharing.

Since the polarity signal POL is not switched in the line period LP4 and the voltage difference between the driving signals Yj, Yj+1 in the line periods LP4 and LP5 are small, the image algorithm unit IAU determines the charge sharing conditions CSC0 and CSC1 are not satisfied. According to the channel data in the channel data group of the channel data CDx, the image algorithm unit IAU acknowledges that the power consumption is decreased when the driving signals corresponding to the channel data group of the channel data CDx and having the same polarity perform the charge sharing. In such a condition, the image algorithm unit IAU determines the charge sharing condition CSC2 is satisfied and selects the charge sharing control command CS2 as the charge sharing control signal CSS. The driving signals Yj and Yj+1 respectively perform the charge sharing with the driving signals corresponding to the same channel data group and having the same polarity, to reduce the power consumption of the driving module 100.

Similar to the line period LP1, the polarity signal POL is switched before the line period LP5 ends. The image algorithm unit IAU determines the charge sharing condition CSC0 is satisfied and selects the charge sharing control command CS0 as the charge sharing control signal CSS, for making the driving signals Y1-Yc to perform the charge sharing. In line period LP6, the image algorithm unit IAU determines all of the charge sharing conditions CSC0-CSCd are not satisfied and selects a charge sharing control command CS_idle as the charge sharing control signal CSS. According to the charge sharing control command CS_idle, the driving module 100 does not perform the charge sharing.

In FIG. 6, the image algorithm unit IAU also adjusts the maximum B_H, the minimum B_L and the duty cycle of the static current for generating the driving signals Yj and Yj+1 according to the difference between the channel data CDx corresponding to the adjacent line periods (e.g. the difference between the absolute voltage values of the driving signals Yj, Yj+1 in the adjacent line periods).

Figure 7:
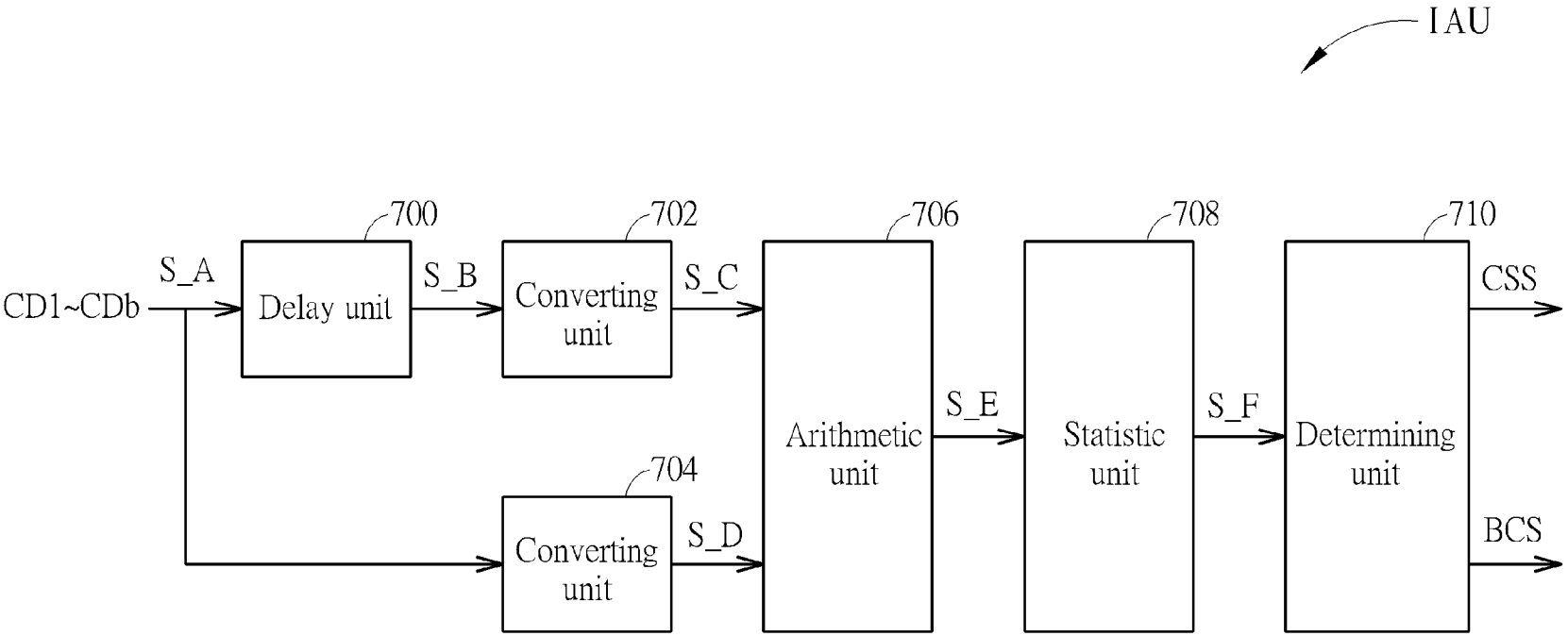
FIG. 7 is a schematic diagram of a realization of the image algorithm unit shown in FIG. 1.

Please refer to FIG. 7, which is a schematic diagram of a realization of the image algorithm unit IAU shown in FIG. 1. As shown in FIG. 7, the image algorithm unit IAU comprises a delay unit 700, converting units 702, 704, an arithmetic unit 706, a statistic unit 708 and a determining unit 710. The delay unit 700 is utilized for delaying the channel data CD1-CDb at least one line period and transmitting the delayed channel data CD1-CDb to the converting unit 702. The converting units 702 and 704 are utilized for converting the channel data CD1-CDb and the delayed channel data CD1-CDb from digital values (e.g. grey level values) to the voltages of a gamma curve. The arithmetic diagram 706 is coupled to the converting units 702 and 204 for performing the arithmetic logic operations such as additions, subtractions and moving averages. The statistic unit 708 is coupled to the arithmetic unit 706 for gathering statistics, such as averages, the maximum, and the minimum, according to the data outputted by the arithmetic unit 706. On the basis of the statistics generated by the statistic unit 708, the determining unit 710 selects the appropriate charge sharing control command and the bias current command as the charge sharing control signal CSS and the bias control signal BCS from the charge sharing control commands CS0-CSd and the bias current commands BC0-BCe.

Figure 8:
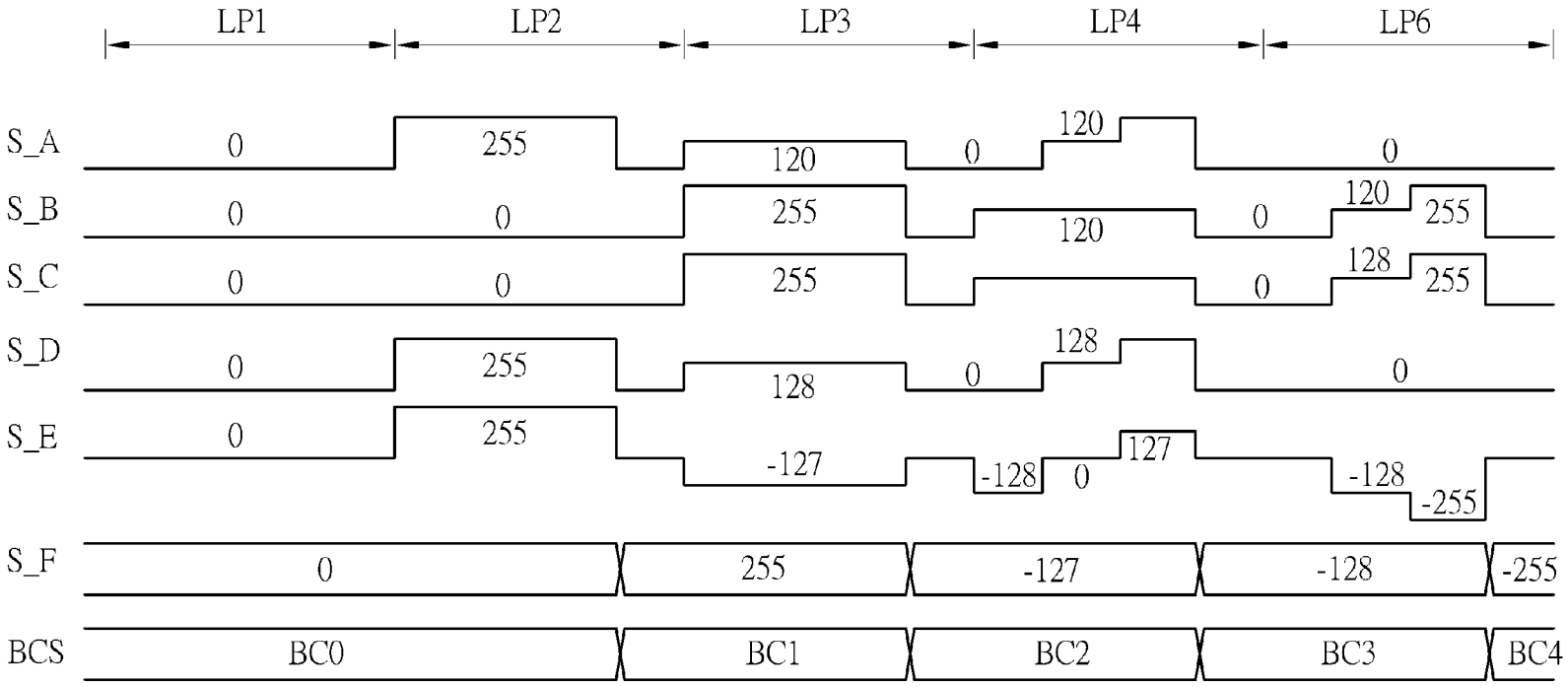
FIG. 8 is a schematic of related signals when the image algorithm unit shown in FIG. 7 operates.

Please jointly refer to FIG. 8, which is a schematic diagram of related signals when the image algorithm IAU shown in FIG. 7 operates. The following descriptions take the channel data CDx as an example. In FIG. 8, the signal S_A is the received channel data CDx. The delay unit 700 delays the signal S_A a line period to generate the signal S_B. Via the converting units 702 and 704, the signals S_B and S_A are respectively converted to signals S_C and S_D having the corresponded gamma voltages. Next, the arithmetic unit 706 acquires the difference between the signals S_D and S_C as a signal S_E and the statistic unit 708 acquires the maximum of the absolute value of the signal S_E as the signal S_F. According to the signal S_F, the determining unit 710 selects one of the bias current command BC0-BCe as the bias control signal BCS.

As shown in FIG. 8, the image algorithm unit IAU begins to operate in the line period LP1 and the signals S_A-S_F are all 0. In such a condition, the determining unit 710 selects the bias control command BC0 as the bias control signal BCS. In the subsequent line period LP2, the signal S_A changes to 255 and the signal S_D also change to 255. Since the signal S_E is the difference between the signals S_D and S_C, the signal S_E also becomes 255. Before the line period LP2 ends, the statistic unit 708 acquires 255, which has the maximum absolute value of the signal S_E in the line period LP2, as the signal S_F and the determining unit 710 changes to select the bias control command BC1 as the bias control signal BCS. When the absolute value of the signal S_F becomes greater, the variations of the driving signals corresponding to the channel data CDx is greater. Thus, the current values (e.g. the maximum B_H and the minimum B_L shown in FIG. 5) and the duty cycle (e.g. the duty cycle DUT shown in FIG. 5) indicated by the bias control command BC1 should be greater than those indicated by the bias control command BC0. For example, the current values indicated by the bias control command BC1 may be 4 times of those indicated by the bias control command BC0 and the duty cycle indicated by the bias control command BC1 may be double of that indicated by the bias control command BC0.

In the line period LP3, the signal S_A is 120, the signal S_D is 128, and the signals S_B and S_C are the signals S_A and S_D in the line period LP2. In such a condition, the signal S_E becomes −127. Before the line period LP3 ends, the statistic unit 708 acquires −127, which has the maximum absolute value of the signal S_E in the line period LP3, as the signal S_F and the determining unit 708 changes to select the bias control command BC2 as the bias control signal BCS. Since the absolute value of −127 is within 0-255, the current values and the duty cycle indicated by the bias control command BC2 is between those indicated by the bias control commands BC0 and BC1. For example, the current values indicated by the bias control command BC2 may be double of those indicated by the bias control command BC0 and the duty cycle indicated by the bias control command BC2 may be 1.4 times of that indicated by the bias control command BC0.

In the line period LP4, the signal S_A is stepwise increased to 120 and 255, the signal S_D is also stepwise increased to 128 and 255, the signals S_B and S_C are the signals S_A and S_D in the line period LP3. Under such a condition, the signal S_E is increased from −128 to 0 and then increased to 127. Before the line period LP4 ends, the statistic unit 708 acquires −128 as the signal S_F and the determining unit 708 changes to select the bias control command BC3 as the bias control signal BCS. For example, the current values indicated by the bias control command BC3 may be 2.5 times of those indicated by the bias control command BC0 and the duty cycle indicated by the bias control command BC3 may be 1.6 times of that indicated by the bias control command BC0. The detailed operations of the image algorithm unit IAU in the line period LP5 can be referred to the above and are not narrated herein for brevity.

The timing control module of the above embodiments selects and transmits different charge sharing control commands and bias control commands to the driving units according to the channel data corresponding to different line periods (e.g. the channel data corresponding to different scan lines), to optimize the power consumptions of the driving units. According to different application and design concepts, those with ordinary skill in the art may observe appropriate alternations and modifications.

Figure 9:
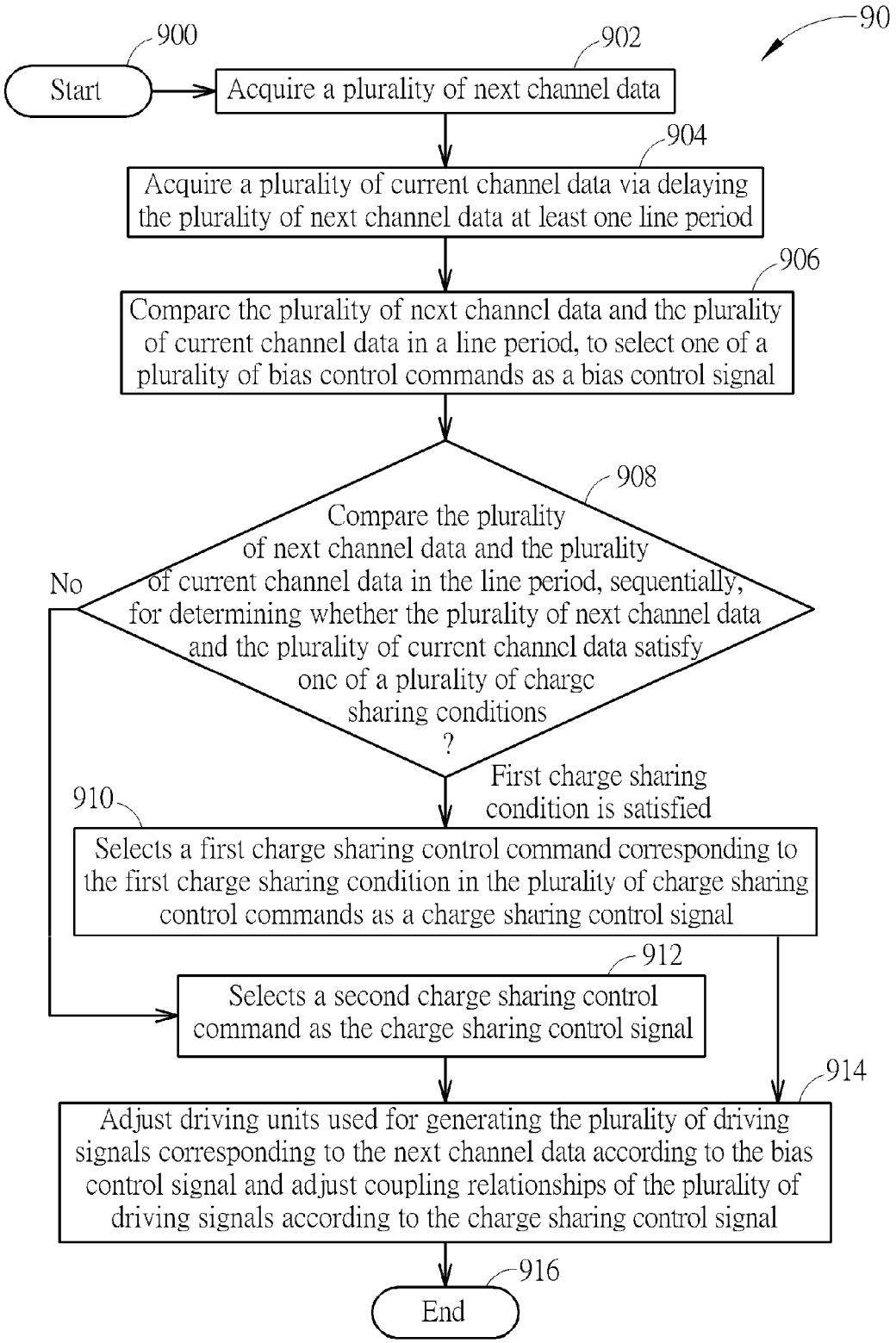
FIG. 9 is a flowchart of a driving device control method according to an embodiment of the present invention.

The process of the image algorithm unit IAU selecting and transmitting different charge sharing control commands and bias control commands to the driving units can be summarized into a driving device control method 90 shown in FIG. 9. The driving device control method 90 is utilized in a driving device generating a plurality of driving signals used for driving a display panel and comprises the following steps:

Step 900: Start.

Step 902: Acquire a plurality of next channel data.

Step 904: Acquire a plurality of current channel data via delaying the plurality of next channel data at least one line period.

Step 906: Compare the plurality of next channel data and the plurality of current channel data in a line period, to select one of a plurality of bias control commands as a bias control signal.

Step 908: Compare the plurality of next channel data and the plurality of current channel data in the line period, sequentially, for determining whether the plurality of next channel data and the plurality of current channel data satisfy one of a plurality of charge sharing conditions, and perform step 910 when a first charge sharing condition is satisfied; otherwise, perform step 912.

Step 910: Selects a first charge sharing control command corresponding to the first charge sharing condition in the plurality of charge sharing control commands as a charge sharing control signal.

Step 912: Selects a second charge sharing control command as the charge sharing control signal.

Step 914: Adjust driving units used for generating the plurality of driving signals corresponding to the next channel data according to the bias control signal and adjust coupling relationships of the plurality of driving signals according to the charge sharing control signal.

Step 916: End.

According to the driving device control method 90, a timing control module of the driving device first acquire a plurality next channel data and delays the plurality of next channel data at least one line period as a plurality current channel data. In a line period, the timing control module compares the plurality of next channel data and the plurality of current channel data, to select one of a plurality of bias control command as a bias control signal according to the differences between the voltages of the same channel in different line periods. In addition, the timing control module sequentially compares the plurality of next channel data and the plurality of current channel data to determine whether one of a plurality of charge sharing control conditions is satisfied, to generate a charge sharing control signal. When the plurality of next channel data and the plurality of current channel data satisfy a first charge sharing condition (e.g. the charge sharing condition CSC0, CSC1 or CSC2) of the plurality of charge sharing conditions, the timing control module select a first charge sharing control command corresponding to the first charge sharing condition (e.g. the charge sharing control command CS0, CS1 or CS2) as the charge sharing control signal; and when the plurality of next channel data and the plurality of current channel data do not satisfy any one of plurality of charge sharing conditions, the timing control module selects a second charge sharing control command (e.g. the charge sharing control command CS_idle) as the charge sharing control signal.

Before the line period ends, a driving module used for generating the plurality of driving signals in the driving device adjusts the current settings of generating the plurality of driving signals according to the bias control signal. Further, the driving module adjusts the coupling relationships in the plurality of driving signals according to the charge sharing control signal. For example, the driving module may couples each of the plurality of driving signals, to make the plurality of driving signals to perform the charge sharing. Or, the driving module may divide the plurality of driving signals into driving signal groups and couple the driving signals in the same driving signal group and with the same polarity (e.g. the driving signals Yj, Yj+2 and Yj+4 or the driving signals Yj+1, Yj+3 and Yj+5) for performing the charge sharing. The power consumption of the driving device is therefore optimized. The detailed operations of the driving device control method 90 can be referred to the above and are not narrated herein for brevity.

To sum up, the driving device of the above embodiments selects different charge sharing control commands and bias control commands according to the data used for generating the driving signals, to adjust the coupling relationships between the driving signals (i.e. perform the charge sharing)

and the static currents used for generating the driving signals. The power consumption of the driving device is accordingly optimized.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving device, comprising:

a driving module, for generating a plurality of driving signals according to a plurality of next channel data and adjusting coupling relationships of the plurality of driving signals according to a charge sharing control signal; and a timing control module, for generating the plurality of next channel data and selecting one of a plurality of charge sharing control commands as the charge sharing control signal, delaying the plurality of next channel data at least one line period to acquire a plurality of current channel data, and sequentially comparing the plurality of next channel data and the plurality of current channel data for determining whether the plurality of next channel data and the plurality of current channel data satisfy one of a plurality of charge sharing conditions, to select one of the plurality of charge sharing control commands as the charge sharing control signal.

2. The driving device of claim 1, wherein when a first next channel data of the plurality of next channel data is greater than a first threshold and a first current channel data corresponding to the first next data in the plurality of current channel data is smaller than a second threshold or the first next channel data is smaller than the second threshold and the first current channel data is greater than the first threshold in a first line period, the timing control module determines a first charge sharing condition of the plurality charge sharing conditions is satisfied and selects a first charge sharing control command of the plurality of charge sharing control commands as the charge sharing control signal; and the plurality of driving units couple the plurality of driving signals before the first line period ends according to the first charge sharing control command.

3. The driving device of claim 1, wherein when a first average of the plurality of next channel data is greater than a first threshold and a second average of the plurality of current channel data is smaller than a second threshold, or the first average is smaller than the second threshold and the second average is greater than the first threshold in a first line period, the timing control module determines a first charge sharing condition of the plurality charge sharing conditions is satisfied and selects a first charge sharing control command of the plurality of charge sharing control commands as the charge sharing control signal; and the plurality of driving units couple the plurality of driving signals before the first line period ends according to the first charge sharing control command.

4. The driving device of claim 1, wherein the timing control module divides the plurality of next channel data into a plurality of next channel data groups and divides the plurality of current channel data into a plurality of current channel data groups according to the sequence of the plurality driving signals; the timing control module calculates a first sum of difference between each next channel data of a first next channel data groups in the plurality of next channel data groups and the corresponded current channel data of a first current channel data group in the plurality of current channel groups and a second sum of difference between averages of the first next channel data group and the first current channel data group in a first line period; the timing control module determines a second charge sharing condition of the plurality charge sharing conditions is satisfied and selects a second charge sharing control command of the plurality of charge sharing control commands as the charge sharing control signal; and the plurality of driving units couple the driving signals corresponding to the first next channel data group and having the same polarity before the first line period ends according to the second charge sharing control command.

5. The driving device of claim 1, wherein the timing control module selects one of the bias control commands as the bias control signal according to differences between each of the plurality of next channel data and the corresponded current channel data, and the plurality of the driving units adjust static currents of generating the plurality of driving signals according to the bias control signal.

6. The driving device of claim 5, wherein the plurality of driving units adjust at least one of a maximum of the static currents, a minimum of the static currents and a duty cycle of the static currents maintaining at the maximum according to the bias control signal.

7. The driving device of claim 1, wherein the timing control module comprises:

a delay unit, for delaying the plurality of next channel data at least one line period as the plurality of current channel data;

a converting unit coupled to the delay unit, for converting the plurality of next channel data and the plurality of current channel data to gamma voltages;

an arithmetic unit coupled to the converting unit, for performing arithmetic logic operations on the plurality of next channel data and the plurality of current channel data;

a statistic unit coupled to the arithmetic unit, for gathering statistics according to the data outputted by the arithmetic unit; and a determining unit coupled to the statistic unit, for selecting one of the plurality of charge sharing control command as the charge sharing control signal according to the statistics.

8. A driving device control method, comprising:

generating a plurality of driving signals according to a plurality of next channel data;

selecting one of a plurality of charge sharing control commands as a charge sharing control signal; and adjusting coupling relationships of the plurality of driving signals according to the charge sharing control signal;

wherein the step of selecting one of the plurality of charge sharing control commands as the charge sharing control signal comprises:

delaying the plurality of next channel data at least one line period as a plurality of current channel data; and comparing the plurality of next channel data and the plurality of current channel data, sequentially, for determining whether the plurality of next channel data and the plurality of current channel data satisfy one of a plurality of charge sharing conditions, to select one of the plurality of charge sharing control commands as the charge sharing control signal.

9. The driving device control method of claim 8, wherein the step of comparing the plurality of next channel data and the plurality of current channel data, sequentially, for determining whether the plurality of next channel data and the plurality of current channel data satisfy one of the plurality of charge sharing conditions, to select one of the plurality of charge sharing control commands as the charge sharing control signal comprises:

determining a first charge sharing condition of the plurality charge sharing conditions is satisfied and selecting a first charge sharing control command of the plurality of charge sharing control commands as the charge sharing control signal when a first next channel data of the plurality of next channel data is greater than a first threshold and a first current channel data corresponding to the first next channel data in the plurality of current channel data is smaller than a second threshold or the first next channel data is smaller than the second threshold and the first current channel data is greater than the first threshold in a first line period; and coupling the plurality of driving signals before the first line period ends according to the first charge sharing control command.

10. The driving device control method of claim 8, wherein the step of comparing the plurality of next channel data and the plurality of current channel data, sequentially, for determining whether the plurality of next channel data and the plurality of current channel data satisfy one of the plurality of charge sharing conditions, to select one of the plurality of charge sharing control commands as the charge sharing control signal comprises:

determining a first charge sharing condition of the plurality charge sharing conditions is satisfied and selecting a first charge sharing control command of the plurality of charge sharing control commands as the charge sharing control signal when a first average of the plurality of next channel data is greater than a first threshold and a second average of the plurality of current channel data is smaller than a second threshold, or the first average is smaller than the second threshold and the second average is greater than the first threshold in a first line period; and coupling the plurality of driving signals before the first line period ends according to the first charge sharing control command.

11. The driving device control method of claim 8, wherein the step of comparing the plurality of next channel data and the plurality of current channel data, sequentially, for determining whether the plurality of next channel data and the plurality of current channel data satisfy one of the plurality of charge sharing conditions, to select one of the plurality of charge sharing control commands as the charge sharing control signal comprises:

dividing the plurality of next channel data into a plurality of next channel data groups and dividing the plurality of current channel data into a plurality of current channel data groups according to the sequence of the plurality driving signals;

calculating a first sum of difference between each next channel data in a first next channel data groups of the plurality of next channel data groups and the corresponded current channel data in a first current channel data group of the plurality of current channel groups in a first line period;

calculating a second sum of difference between averages of the first next channel data group and the first current channel data group in the first line period;

determining a second charge sharing condition of the plurality charge sharing conditions is satisfied and selecting a second charge sharing control command of the plurality of charge sharing control commands as the charge sharing control signal; and coupling the driving signals corresponding to the first next channel data group and having the same polarity before the first line period ends according to the second charge sharing control command.

12. The driving device control method of claim 8, further comprising:

selecting one of the bias control commands as the bias control signal according to differences between each of the plurality of next channel data and the corresponded current channel data; and adjusting static currents of generating the plurality of driving signals according to the bias control signal.

13. The driving device control method of claim 12, wherein the step of adjusting the static currents of generating the plurality of driving signals according to the bias control signal comprises:

adjusting at least one of a maximum of the static currents, a minimum of the static currents and a duty cycle of the static currents maintaining at the maximum according to the bias control signal.

* * * * *